US009205301B2

(12) United States Patent
Cohen

(10) Patent No.: US 9,205,301 B2
(45) Date of Patent: Dec. 8, 2015

(54) UNIVERSAL SUPPORT PLATFORM FOR EXERCISE BICYCLES AND EXERCISE SYSTEM WITH VIRTUAL REALITY SYNCHRONICITY

(71) Applicant: VirtuRide LLC, Sunny Isles Beach, FL (US)

(72) Inventor: Omer Cohen, Sunny Isles Beach, FL (US)

(73) Assignee: VirtuRide LLC, Sunny Isles Beach, FL (US)

( * ) Notice: Subject to any disclaimer, the term of this patent is extended or adjusted under 35 U.S.C. 154(b) by 71 days.

(21) Appl. No.: 14/190,662

(22) Filed: Feb. 26, 2014

(65) Prior Publication Data

US 2014/0243156 A1 Aug. 28, 2014

Related U.S. Application Data

(60) Provisional application No. 61/769,298, filed on Feb. 26, 2013.

(51) Int. Cl.

*A63B 22/00* (2006.01)
*A63B 24/00* (2006.01)
*A63B 71/02* (2006.01)
(Continued)

(52) U.S. Cl.

CPC ..... *A63B 24/0087* (2013.01); *A63B 22/0023* (2013.01); *A63B 71/023* (2013.01); *A63B 71/0622* (2013.01); *A63B 21/225* (2013.01); *A63B 22/0605* (2013.01); *A63B 2022/0641* (2013.01); *A63B 2022/0658* (2013.01); *A63B 2024/009* (2013.01); *A63B 2024/0096* (2013.01); *A63B 2071/0625* (2013.01); *A63B 2071/0638* (2013.01); *A63B 2071/0658* (2013.01); *A63B 2220/30* (2013.01); *A63B 2220/76* (2013.01); *A63B 2220/78* (2013.01); *A63B 2225/107* (2013.01); *A63B 2225/50* (2013.01); *A63B 2230/06* (2013.01)

(58) Field of Classification Search

USPC ..... 482/1–148
See application file for complete search history.

(56) References Cited

U.S. PATENT DOCUMENTS 3,633,918 A * 1/1972 Smiley ..... A63B 69/3652 473/279
4,925,183 A 5/1990 Kim
(Continued)

FOREIGN PATENT DOCUMENTS

| | | | |
|---|---|---|---|
| JP | 2005021391 | A | 1/2005 |
| KR | 101184984 | B1 | 10/2012 |
| WO | 2010075481 | A1 | 7/2010 |

*Primary Examiner* — Stephen Crow
(74) *Attorney, Agent, or Firm* — Laurence Greenberg; Werner Stemer; Ralph Locher

(57) ABSTRACT

A platform assembly includes a lower box, which is supported at the corners on inflatable feet, and a platform which is tiltable relative to the lower box by a lifter mechanism inside the box. The platform assembly is universally usable to support exercise equipment, in particular exercise bicycles such as spinning cycles. A complete studio may be outfitted by supporting each of a multitude of exercise cycles on a universal platform. A screen display in front of the cycles plays a moving picture of a trip, which is emulated by the participants in the exercise and workout routine. The platform is raised and lowered, as well as tilted, in synchronicity with the display. On raising the front of the platform, which represents an incline in the travel path, the resistance of the bicycle is increased.

8 Claims, 4 Drawing Sheets

(51) Int. Cl.

| | |
|---|---|
| ***A63B 71/06*** | (2006.01) |
| *A63B 21/22* | (2006.01) |
| *A63B 22/06* | (2006.01) |

(56) References Cited

U.S. PATENT DOCUMENTS

| | | | | |
|---|---|---|---|---|
| 5,240,417 | A | 8/1993 | Smithson et al. | |
| 5,551,920 | A * | 9/1996 | Ogden | G09B 9/02 434/55 |
| 5,820,478 | A * | 10/1998 | Wood | A63B 69/3652 473/279 |
| 6,225,977 | B1 * | 5/2001 | Li | G05G 1/52 345/156 |
| 6,613,003 | B1 * | 9/2003 | Bles | A61B 5/1036 600/587 |
| 6,663,498 | B2 * | 12/2003 | Stipan | A63B 69/3652 108/7 |
| 7,226,395 | B2 | 6/2007 | Wu et al. | |
| 7,303,510 | B2 | 12/2007 | Gebhardt | |
| 7,335,134 | B1 * | 2/2008 | LaVelle | A63B 23/0211 463/36 |
| 7,438,672 | B1 * | 10/2008 | Rylander | A63B 220/0605 446/396 |
| 7,857,732 | B2 * | 12/2010 | Nielson | A63B 22/0605 482/57 |
| 8,251,874 | B2 | 8/2012 | Ashby et al. | |
| 8,613,691 | B2 * | 12/2013 | Bosecker | A61H 1/005 482/54 |
| 2002/0055422 | A1 * | 5/2002 | Airmet | A63B 22/16 482/61 |
| 2005/0164843 | A1 | 7/2005 | Papadopoulos | |
| 2006/0122035 | A1 | 6/2006 | Felix | |
| 2007/0042868 | A1 | 2/2007 | Fisher et al. | |
| 2011/0164044 | A1 * | 7/2011 | Huang | A63B 21/0004 345/473 |
| 2012/0071300 | A1 | 3/2012 | Shapiro | |
| 2012/0071301 | A1 * | 3/2012 | Kaylor | A63B 21/00058 482/57 |

* cited by examiner

FIG. 7
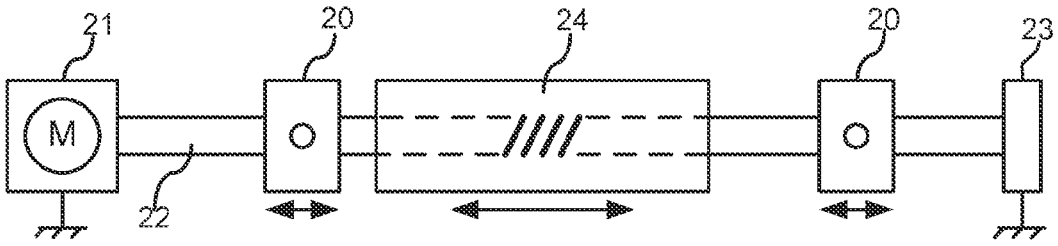
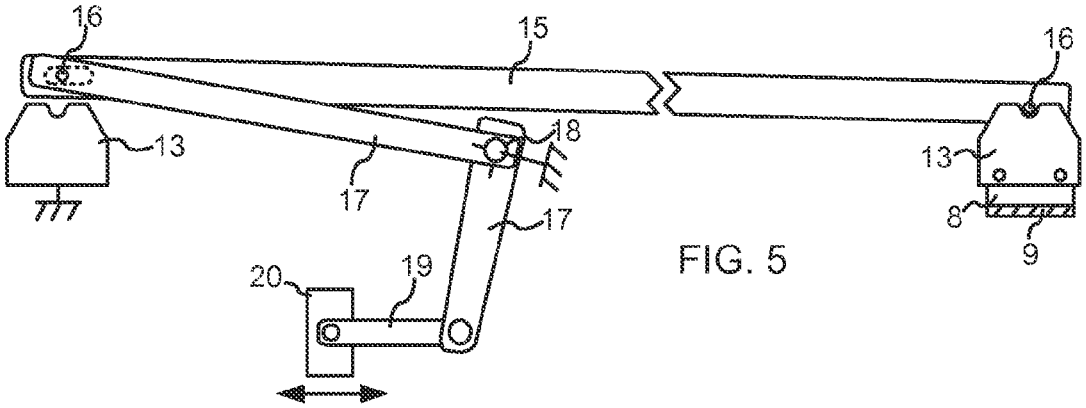
FIG. 5

UNIVERSAL SUPPORT PLATFORM FOR EXERCISE BICYCLES AND EXERCISE SYSTEM WITH VIRTUAL REALITY SYNCHRONICITY

CROSS-REFERENCE TO RELATED APPLICATION

This application claims the benefit, under 35 U.S.C. §119 (e), of provisional patent application 61/769,298, filed Feb. 26, 2013; the prior application is herewith incorporated by reference in its entirety.

BACKGROUND OF THE INVENTION

Field of the Invention

The invention lies in the field of exercise equipment and virtual reality-to-human interfaces. More specifically, the invention relates to a universal support system for supporting an exercise bicycle and to a virtual reality and exercise system.

The prior art includes numerous embodiments of exercise devices in the form of stationary bikes. One such example, in a highly developed form, is described in U.S. Pat. No. 8,251,874 B2 to Ashby et al. ("Ashby"). There, there is disclosed an exercise system with simulated real world terrain.

Ashby describes an exercise system that includes one or more exercise devices that communicate via a network with a communication system. The communication system stores and/or generates exercise programming for use on the exercise device. The exercise programming is able to control one or more operating parameters of the exercise device to simulate terrain found at a remote, real world location. The exercise programming can include images/videos of the remote, real world location. The control signals and the images/videos can be synchronized so that a user of the exercise device is able to experience, via the changing operating parameters, the topographical characteristics of the real world location as well as see images of the location.

In sum, Ashby discloses, in a system of one or more exercise devices, controlling one or more operating parameters of the exercise device to simulate terrain found at a remote, real world location, with synchronized control signals and images/videos.

The Ashby patent discloses devices that include one or more motors or other electrically driven actuators used to control one or more operating parameters of an exercise device. Also, the exercise cycle is developed in that the amount of braking applied to a flywheel can vary the speed at which a user can pedal and/or the resistance experienced by the user as he or she pedals to simulate the types of resistances and pedaling speeds that a user may experience if riding a bicycle outdoors.

The prior art patent further discloses, in addition to the ability to control and vary the speed and resistance of the pedal assembly, that the exercise cycle also permits the tilting of the upright support frame relative to the floor or other surface upon which exercise cycle rests.

While the prior art disclosure provides for a highly developed exercise system, it lacks in ready adaptability for a variety of environments and it is quite limited to the types of synchronized parameters. The latter being a drawback that limits the user's feeling of "reality" in the virtual reality system.

A major drawback is that the prior art cycles, and many of the related exercise devices of the prior art alike, are quite expensive. In order to acquire the functionality of the prior art exercise device, one must acquire the entire device. This may be acceptable for a private purchase, but it becomes prohibitively expensive for gyms and studios that require a multiplicity of such devices.

SUMMARY OF THE INVENTION

It is an object of the invention to provide a support for an exercise device and a fully integrated virtual reality exercise system which overcome various disadvantages of the heretofore-known devices of this general type and which provide for ready adaptability to existing systems, ready retrofitting for exercise studios or private use, and a system with highly developed virtual reality touch and feel.

With the foregoing and other objects in view there is provided, in accordance with the invention, a platform assembly for supporting exercise equipment, such as a spinning cycle, the assembly comprising:

a lower box with four height-adjustable corner supports for supporting the platform assembly on a substantially level floor surface;

a platform supported on the lower box and carrying mounting devices for rigidly attaching exercise equipment on the platform, the platform defining a longitudinal direction substantially along a center line thereof and a transverse direction perpendicular thereto;

a lifter mechanism disposed in the lower box and configured to selectively lift a forward part of the platform relative to the lower box to incline the platform in a forward direction or to lift a rearward part of the platform relative to the lower box to decline the platform in a forward direction;

a controller in communication with the four height-adjustable corner supports and with the lifter mechanism, the controller being configured to remotely drive the lifter mechanism to selectively incline or decline the platform and to remotely drive each of the corner supports to selectively raise or lower the lower box at a respective corner thereof.

The novel system of the invention provides for the full functionality of the exercise devices by way of its retrofit capability. Instead of purchasing a slew of corresponding devices, it is possible, according to the invention, to mount existing devices (as many as desired) to functional platform supports (as many as desired). The platform is thus a universal platform providing a universal solution. It is possible to place any and all types of exercise devices, which may already be in the possession of the facility, on the universal platform. For a new purchase, also, the novel platform system allows a full selection of any of a variety of exercise devices that are available on the market and then to place the same of the novel universal platform.

In accordance with an added feature of the invention, each of the corner supports comprises a bearing block rigidly mounted to the lower box, an inflatable airbag supported in the bearing block, and a nozzle for fluidically connecting the inflatable airbag to a pressurized air source for inflating the airbag to thereby lift the bearing block and the lower box relative to the floor surface.

In accordance with an additional feature of the invention, the corner supports have a bracket rigidly connected to the bearing block, the platform having a rigid frame which, in a position of repose of the platform, rests on all four of the bearing blocks and, when the platform is inclined rests on two the bearing blocks of two rear-side corner supports and when the platform is declined rests on two the bearing blocks of two front-side corner supports.

In accordance with a further feature of the invention, the lifter mechanism comprises:

a linkage formed with first and second links at a forward end of the platform and first and second links at a rearward end of the platform, the linkage being mounted on a rotatable axle with the first and second links enclosing an angle of approximately 90° in a side view thereof, the rotatable axle being rotatably supported on the lower box, and the second link having a free end thereof connected to the platform, wherein a substantially horizontal movement of a free end of the first link translates into a substantially vertical movement of the free end of the second link for lifting the platform at the forward end or at the rearward end;

a motor and a lead screw driven by the motor to selectively rotate in left rotation and in right rotation, the lead screw extending substantially along the longitudinal direction;

a pusher block disposed to mesh with the lead screw and to move along the lead screw when the lead screw is rotated; and a push/pull block disposed at a forward face of the pusher block and a push/pull block disposed at a rearward face of the pusher block, each the push/pull block being connected to move the free end of the respectively associated the first link upon being pushed by the pusher block, to thereby lift either the forward end of the platform or the rearward end of the platform.

In accordance with again an added feature of the invention, the corner supports include inflatable airbags which, upon inflation, lift the respective corner of the lower box a given spacing distance from the floor surface and wherein, with the inflatable airbags inflated, the lower box is raised above the floor surface and supported substantially horizontally and cushioned by the inflated airbags, a pressurized air source for inflating the airbags is fluidically connected to each of the inflatable airbags, and the lifter mechanism is configured to incline or decline the platform independently of an inflation or deflation of the inflatable airbags.

With the above and other objects in view there is also provided, in accordance with the invention, an exercise studio configuration, comprising:

a display screen and a video system for displaying moving images on the display screen;

a plurality of platform assemblies each as summarized above disposed to face the display screen and an exercise bicycle mounted on each of the platform assemblies;

a controller connected to the video system and to each of the platform assemblies, the controller controlling a selective inflation and deflation of the inflatable airbags and a selective raising and lowering of the platform by the lifter mechanism in synchronicity with a content of the moving images being displayed on the display screen.

The primary implementation of the invention is a system with a large screen—preferably several meters high and several meters wide—and several platforms that are pointed towards the screens. Each of the platforms forms a support for an exercise device, such as a stationary bicycle used in spinning classes. The platforms can be tilted about a transverse axis (i.e., substantially perpendicular to a forward-looking direction) and about a longitudinal axis; they can be vibrated at various frequencies; and they can be moved laterally, substantially parallel to the transverse axis.

The preferred exercise devices are exercise cycles (such as are found in existing indoor cycling/spinning studios) that operate in a virtual reality environment, synchronized with a projected real course video provided by a controller that coordinates events synchronized to events in the video.

The platforms on which the exercise devices (e.g., cycles) are disposed are provided with actuators, operated by signals from a main computer, for raising or lowering an elevation of the cycle, for vibrating the platform, for lateral movement, and for creating a variable resistance force against the flywheel to simulate an incline synchronized with an incline in the projected real course video, with all cycles operating at the same incline and traversing the same projected course.

The display screen upon which the projected real course video is viewed is either a curved screen or the studio wall onto which the display movie (and additional messages, such as exercise parameters and advertising) is projected. The display may also be an active display, formed with a plurality of television displays disposed to form a single screen and synchronized to each display a portion of the image. The screen, preferably, partly wraps around the cycles to give the participants a feeling of a real view and surround sound. It is possible, in addition, to use further visual stimulation—for instance laser machines shooting laser beams to provide a night club-like experience—to stimulate the exercise output of the individual. If projection onto the studio wall is desired, the wall is preferably coated/painted with especially reflective material that is particularly suited for that purpose. It is also possible to use two walls, meeting in a corner, to display the projection or two projections.

There is also provided an audio system, preferably a surround sound system. It should also be understood that each station may be provided with its own audio feed. The audio feed may be presented through a phone jack and one or two controls for the sound volume and optionally for a user-controlled mix between the terrain and wind sounds (i.e., the audio of the video display) and the user's own selection.

The platforms are equipped with a synchronized lifter motor that reflects the current inclination of the terrain in the video display. There is also provided a second lifter system for lateral movement (right/left) of the support platform which resembles the real movement of a cyclist on a road as he/she pedals. The implementation with the "soft" inflatable feet support provides for a particularly life-like behavior of the exercise bike, allowing ready left/right pivoting by the rider. The two motions are superimposed onto one another. Finally, there may be provided a "shaker" or vibrator that provides a realistic feel of ground contact between the bike and the underlying surface. The vibrator may have a variable frequency in order to be able to provide for different ground surfaces (e.g., low frequency for gravel, higher frequency for asphalt, etc.).

The video is time coded. The coding signal is sent wirelessly (preferably by Bluetooth) from the main display controller to each of the platforms. It is, of course, also possible to hardwire each of the platforms.

The video display screen, furthermore, may be efficiently used for advertisements that are superimposed into the display or even flashed during a video.

In order to provide yet a more realistic feel for the system, I place blower fans in front (on the floor or on the platform) so as to suggest wind impingement on the "virtually" moving cyclist. The fans may be synchronized with the display as well, or they may be connected to a timer that is programmed to work in different intensities as programmed by the operator.

Other features which are considered as characteristic for the invention are set forth in the appended claims.

Although the invention is illustrated and described herein as embodied in a support platform and a virtual reality exercise system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 5 is a side view of the platform support frame and the platform lifter linkage and mechanism;

FIG. 7 is a schematic side view of the drive mechanism for the lifter mechanism;

DETAILED DESCRIPTION OF THE INVENTION

Figure 1:
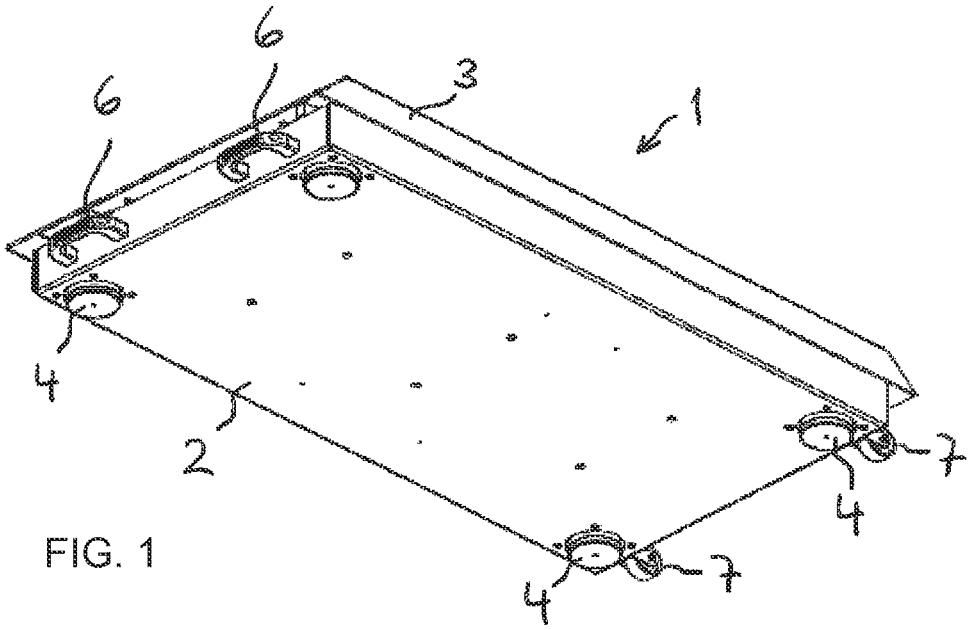
FIG. 1 is a bottom perspective view of an exemplary embodiment of a platform assembly according to the invention.
Figure 2:
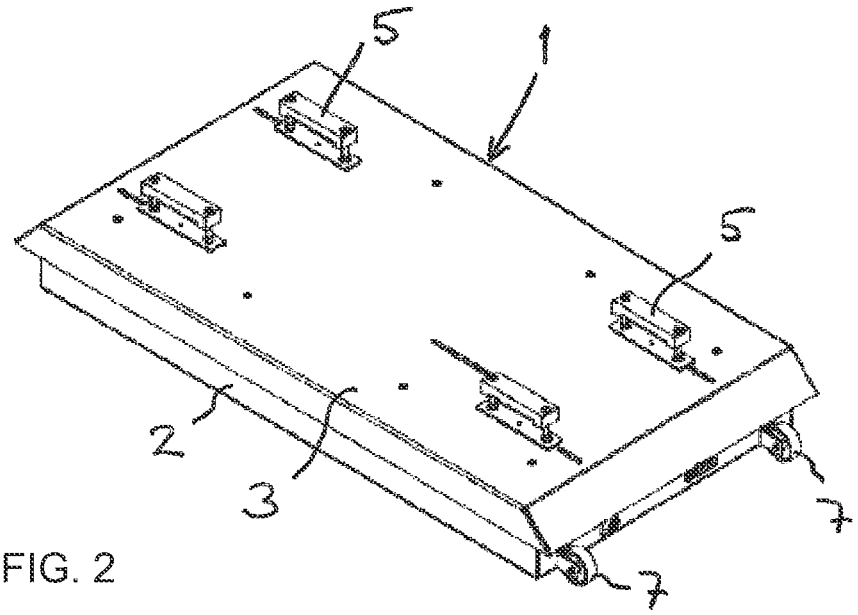
FIG. 2 is a top perspective view of the platform assembly.

Referring now to the figures of the drawing in detail and first, particularly, to FIGS. 1 and 2 thereof, there is seen an exemplary embodiment of a platform assembly 1 according to the invention. The platform assembly 1 is generally rectangular, with long sides that are approximately twice as long as the short sides. The platform assembly 1 is shown from below in FIG. 1 and from above in FIG. 2. The platform assembly includes a lower box 2, which houses a variety of mechanical elements—to be described in the following—and a support platform 3. There are provided four corner supports 4 which, in a preferred embodiment, are formed with airbag supports or inflatable rubber feet. The purpose of these supports 4 will become clear from the following text. The platform 3 has four mounting brackets 5 for attaching exercise equipment such as an exercise bicycle. There are also provided a pair of handles 6 in the front and a pair of rollers 7 in the back. These convenience elements allow the platform assembly to be moved relatively easily.

Figure 3:
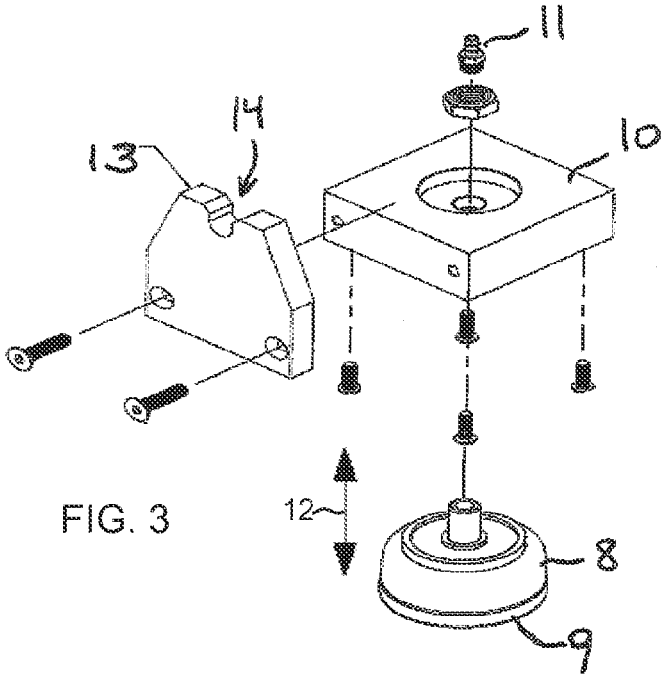
FIG. 3 is an exploded view of an inflatable corner support.
Figure 4:
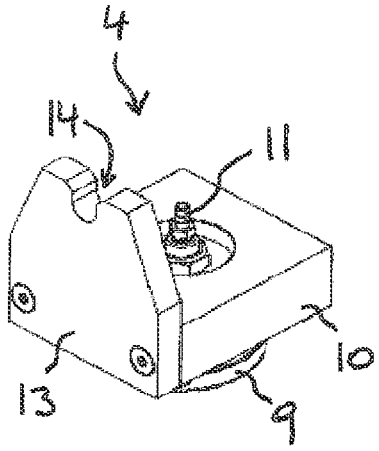
FIG. 4 is a perspective view of the corner support.

Referring now to FIGS. 3 and 4, there is illustrated a subassembly for an inflatable corner support 4. The corner support 4 has an airbag 8 and a foot support 9, such as a non-slip rubber pad. The airbag 8 is supported in a block 10, which is formed with a seat into which the airbag 8 partly dives. A nozzle 11 connects to the airbag interior and allows the same to be inflated and deflated. On inflation, the airbag 8 expands along the direction of an arrow 12. Inflating the airbag 8 will lift the platform assembly at the given corner and deflating the airbag 8 will lower the platform assembly. The maximum amplitude of the expansion defines the maximum amplitude of lift, or stroke, of the platform assembly 1.

The subassembly for the corner support 4 further includes a bracket 13 which is affixed to the block 10, thus forming a rigid and direct mechanical connection between the block 10 and a depression 14 which is formed in the bracket 13. As will become clear from the following, the depression 14 is configured to receive a pivot bar of the linkage that carries the platform 3. That is, the platform 3, or its structural frame, is directly supported on the corner support assembly, thus providing an immediate and direct mechanical connection.

Figure 6:
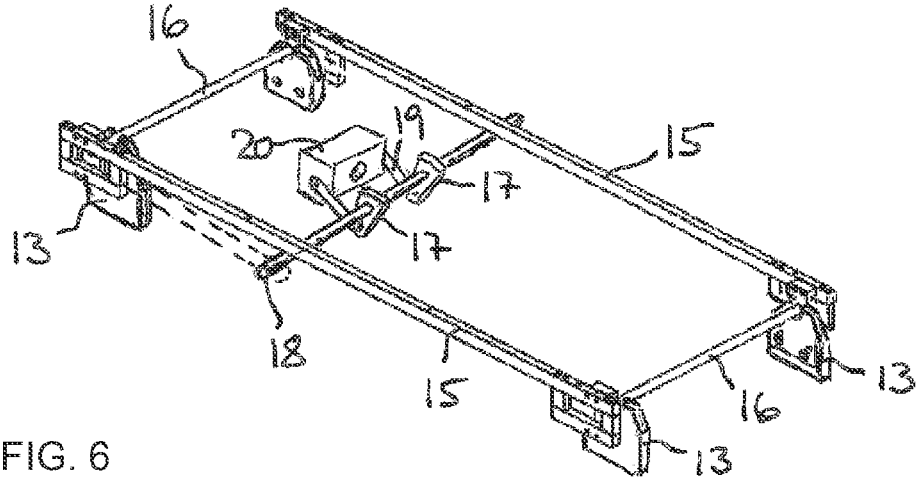
FIG. 6 is a perspective view of the platform support frame.

Referring now to FIGS. 5 and 6, there is shown a side view and a simple perspective view of a structural frame for supporting the platform 3. The frame has two long sides 15, or lateral struts, and two short sides 16, or transverse struts. The frame 15, 16 is a rigid construction and it supports a substantially flat plate forming the platform 3. In its repose position, the frame rests on the four corner supports 4, with the transverse struts 16, or extension bars thereof, nestling in the respective depression 14 of each of the brackets 13. The depressions 14 are formed with a substantially semi-circular base and a chute-type entry ramp. When the struts or bars 16 are supported in the brackets 13, they are able to pivot or rotate inside the depressions 14. The respectively opposite narrow side of the frame can thereby be lifted while the extension bars or struts 16 remain pivotally supported.

FIG. 5 shows the left-hand side of the frame in a slightly lifted position. The lift in this exemplary embodiment is effected by a lifter linkage, which includes a first link 17 and a second link 17'. The two links 17, 17' are disposed similarly to an elbow bracket rigidly affixed to a rotatably supported trunnion or axle 18. As schematically indicated, the axle 18 forms a fixed pivot fulcrum that is fixed relative to the lower box 2. That is, the axle is stationary and rigid relative to the brackets 13, which are mounted on the blocks 10 which, in turn, are supported by the airbags 8. The link 17 is pivotally connected to a further link 19, which connects the elbow to a push/pull block 20. As the block 20 is pushed to the left in the figure, the linkage 19 pulls the first link 17 (i.e., the lower arm of the elbow bracket) to the left and thus forces the second link (17' (i.e., the upper arm of the elbow bracket) to lift upward. That is, the elbow bracket rotates clockwise. The free end of the second link 17' is connected to the extension bar 16, which lifts the left-hand side of the frame out of its support in the bracket 13. The extension bar 16 is supported in an oblong bearing in the side of the frame 15, so as to allow for a given amount of play. The play is required because of the different lengths of the upper arm of the bracket on the one hand and the long sides 15 of the frame, on the other hand. The lifter linkage thus converts a horizontal movement of the block 20 into a substantially vertical movement of the support frame and the platform 3.

The return movement of the platform 3 into its position of repose is simply the opposite of the lifting movement. Here, however, the block 20 is pushed/pulled back to the right by the gravitational force acting on the frame 15, 16 via the platform 3 and the exercise device supported thereon. The return position is reached when the narrow sides with their struts or rods 16 are all supported in their respective brackets 13. It will be understood that the push/pull block 20 is freely movable along the longitudinal direction.

An equivalent lifter linkage is provided on the opposite side of the platform assembly 1. That is, it is possible to lift the right-hand side of the frame and the platform 3 in a corresponding manner as the right-hand side. In the implementation of the lifter mechanism in the preferred embodiment, it is possible to only lift one side at a time. This will be explained with reference to FIG. 7.

FIG. 7 shows a diagram illustrating the injection of a drive moment into the left-hand and right-hand lifter linkages. A motor 21 in the form of a stepper or stepping motor drives a spindle or lead screw 22 in rotation. The stepper motor 21 is an accurately controlled motor with accurate left-hand and right-hand drive control. The lead screw 22 is supported on the opposite side in a rotary bearing 23, which allows the lead screw to rotate freely. The lead screw 22 projects through a push/pull block 20 for the left-hand lifter linkage and through a push/pull block 20 for the right-hand lifter linkage. The lead screw 22 does not engage the blocks 20, but the blocks are freely movable relative to the lead screw 22. A pusher block 24 is disposed between the blocks 20. The pusher block 24 is provided with an inner thread, typically by way of a nut insert, that meshes with the lead screw 22. That is, as the motor 21 rotates the lead screw 22, the pusher block moves to the right or the left, depending on the pitch of the thread and the rotational direction of the motor 21. In a preferred embodiment, the lead of the thread is set so as to require approximately 10 full turns of the lead screw 22 for a one-inch translation of the pusher block 24. Here, therefore, the drive for lifting the platform is based on a conversion of a rotational movement (i.e., the motor/spindle rotation) to a translational movement of the pusher block 24. As noted above, the lifter linkages provide for the horizontal translation of the pusher block to the substantially vertical lifting motion of the respective side of the platform 3.

It will be understood from the illustration that the platform is relatively sturdy and rigidly supported along its longitudinal direction. That is, the selective up-and-down movement by driving the motor 22 in the positive rotational direction or the negative rotational direction injects into the platform a positive and defined movement. The platform is not otherwise freely movable in a forward/backward tilting motion.

This is in effect different in the transverse direction. The platform 1, as noted above, is supported on four corner feet 3 which are formed of inflatable airbags or balloons. The corner feet 4 are so soft as to allow the platform 1 to be tilted left and right, about its longitudinal axis 5. Due to the fact that the tilting injected by a rider on an exercise bike supported on the platform is subject to stronger lateral forces that longitudinal tilting, the platform appears to be supported quite rigidly in the forward/backward direction.

It has proven particularly beneficial for the rider to first ascend the platform and sit on the bicycle while the inflatable airbags 8 are not yet inflated. Then, with the full loading of the exercise bike and the rider, the airbags 8 of the supports 4 are inflated to a given pressure whereupon the platform is raised (selectively by one to three inches), with the platform 3 at a substantially horizontal orientation (i.e., all four supports are inflated to equal pressure). This initial inflation, therefore, provides for a calibration of the system to the weight of the rider and it establishes the rigid forward/backward support while at the same time establishing the apparently soft left/right pivot support. In the context of the preferred implementation of the platform assembly for supporting an exercise bike, the apparently relatively soft and ready left/right tilting together with the relatively rigid forward/backward support resembles a real experience on a bicycle or other two-wheeler. Especially in a standing cycling position, the rider is able to pivot the bike back and forth sideways, leading to a particularly realistic experience.

The platform assembly 1 described herein is a universally usable assembly which is configured to support a variety of training apparatus and exercise equipment. It is also particularly suitable for retrofitting existing systems and exercise studios. Assume, for instance, the studio already has in its possession 20 spinning cycles, which are stationarily mounted on the floor. The studio now can purchase 20 platform assemblies and mount the spinning cycles on the platforms. The further elements and steps for such a retrofit, or a setup for a completely new studio, will become clear from the following description.

Figure 8:
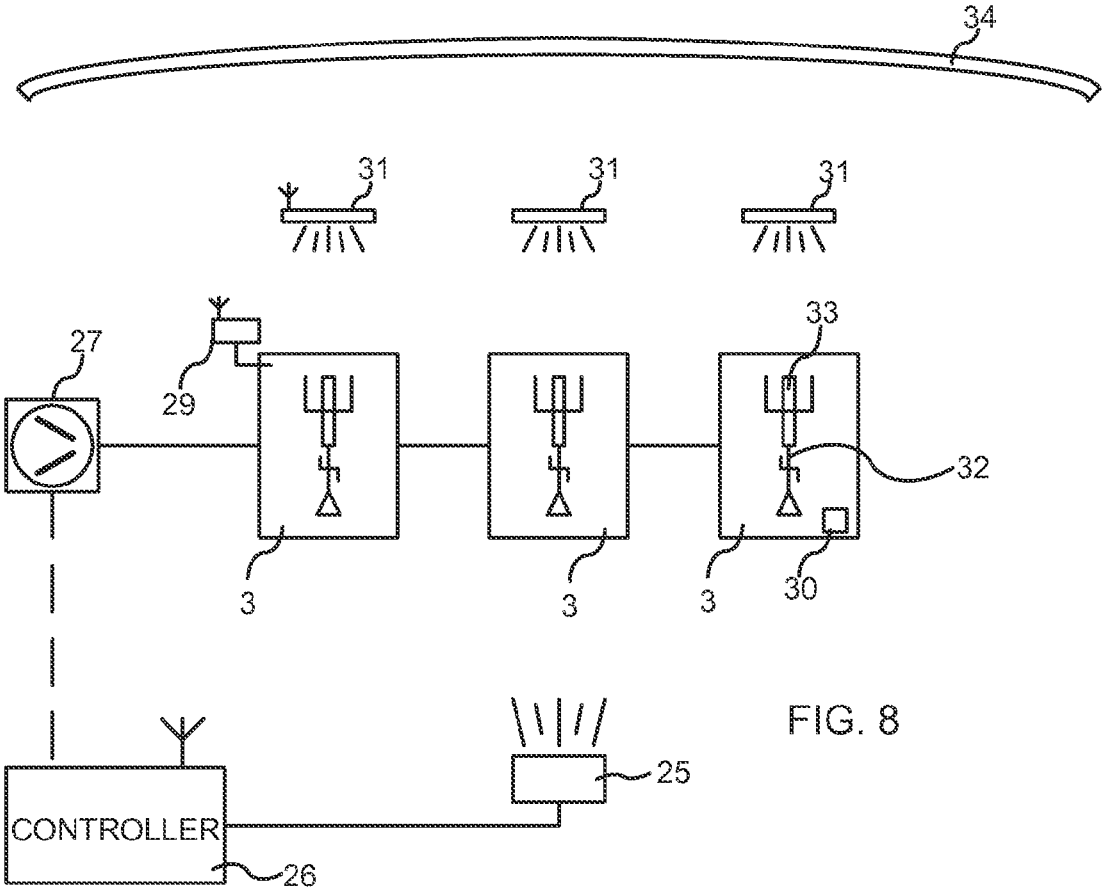
FIG. 8 is a diagrammatic plan view of an exercise studio, illustrated with three exercise stations and display and control equipment.

Referring now to FIG. 8 there is shown a schematic top view of an exemplary exercise studio set up for a spinning class. While only three exercise stations are illustrated, it will be understood that any number of such stations may be provided, depending on the size of the studio and the number of participants. Each support platform 1 has a spinning cycle 32 fixedly mounted and facing forward in the longitudinal direction of the platform 3 and towards a video screen 24 disposed in front of the cycles 32. Each cycle 32 is provided with a flywheel 33. A ceiling-mounted projector or beamer 25 projects onto the screen 24. The screen 24 may be a curved display screen or it may simply be a specially paint-coated wall of the studio. Instead of the illustrated system, there may also be provided a back-projection system, or an active display, such as a full-wall assembly of synchronized LED screens. The beamer 25, that is the display contents, is controlled by a controller 26. In the preferred embodiment, the controller 26 is a computer with the necessary program and interfaces.

In addition to the main display contents, which may, for instance, be a video of a ride along a nature trail, an up-and-down mountain trail, or the like, the display screen may also display exercise parameters. These may include the distance traveled, an average speed, a current speed of the video trip, or even the current speed of the individual riders currently exercising, calories burned, heart rate of the individual riders, and many more.

Corresponding music may be played through a PA system, preferably a surround sound system, and the music feed may be synchronized to the video contents as well. A synchronized lighting system may round out the experience and further raise the level of excitement during the workout.

Figure 9:
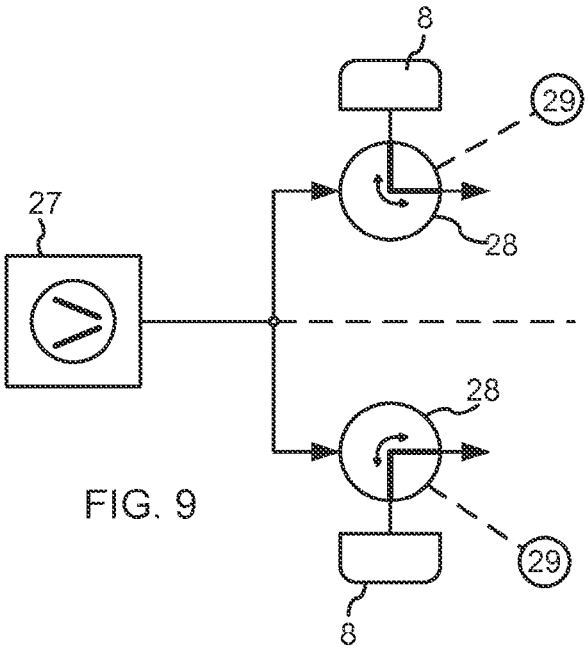
FIG. 9 is a pneumatic diagram showing two of a plurality of controlled inflation/deflation valves.

A pressurized air source in the form of a compressor 27 provides the necessary inflation pressure for the inflatable airbags 8. As shown by the pneumatic diagram of FIG. 9, each of the feet 4 is separately controlled by a three-way valve 28. The three valve settings are "closed," "inflate" and "deflate." When the valve is in the inflation position, the inflatable airbag 8 is inflated to the pressure provided by the compressor 27. Once it is inflated, the valve may be returned to its closed position. In the deflation position, the inflatable airbag 8 is deflated by airing it out to the environment. In FIG. 9, both valves 28 are in the deflate position. The necessary pressure for the deflation is provided by the platform and the weight that is being supported on the platform 3. By controlling the four feet 4 individually, each platform has available to it several positions and motions. For instance, by deflating both forward feet, the platform inclines forwardly. The cycle supported on the platform thus leans forward, as in a downhill ride. By deflating the feet on one side, the cycle leans sideways, as in a curve. Combinations of forward or rearward and sideways tilting motions are possible as well.

In a preferred embodiment, each platform is provided with a control station 29 which communicates with the controller 26 to receive corresponding master control commands, or a recipe. The master control commands are used to provide control commands for each of the controlled systems of the platform. The controlled systems include at least the valves 28 for inflating/deflating the feet 4 and for driving the motor 21.

In addition, there may be provided a rumbling motor 30 (cf. FIG. 8), in the form of an excentric vibration motor. The motor 30 may be turned on, by way of example, if the display video shows travel over gravel roads or other rough terrain. Also, in order to round out a very realistic experience, there are provided blower fans 31. The fans 31 may also be driven in synchronicity with the display, for instance with a faster blow speed for downhill travel display and slower blow speed for uphill travel display. The blower fans may also be synchronized to the pedaling speed of the respective rider, thus allowing each rider to dictate an amount of headwind he or she is experiencing.

The controlled systems are controlled in synchronicity with the display. For that purpose, all of the controlled systems, including the control stations 29, communicate with the controller 26 in order to receive the corresponding recipes. They may either be hard-wired or they may communicate by way of a wireless protocol. A W-LAN system with Internet protocol in packet-driven communication is preferred. Also, Bluetooth communication protocols are suitable, because the Bluetooth communications range is particularly suitable for an exercise studio, and it provides ready adaptation for up to 7 stations. Due to the wireless connection between the controller 26 and the control stations 29, it is possible for any of the exercise stations to be turned off in mid-stream—for example, if that person wishes to take a break—and to be turned on again, without losing the synchronized position. That is, if the station is turned on in mid-stream (or, mid-video for that matter), it is immediately synchronized to the current position in the display.

The novel system is also configured to couple the up/down motion of the platform, which represents uphill/downhill riding on the bike supported on the platform, to the resistance on the flywheel of the exercise bike 32. This can either be achieved by a purely mechanical linkage, by a pneumatic link, or even a further wireless device.

The invention claimed is:

1. A platform assembly for supporting exercise equipment, the assembly comprising:

a lower box with four height-adjustable corner supports for supporting the platform assembly on a substantially level floor surface;

a platform supported on said lower box and carrying mounting devices for rigidly attaching exercise equipment on said platform, said platform defining a longitudinal direction substantially along a center line thereof and a transverse direction perpendicular thereto;

a lifter mechanism disposed in said lower box and configured to selectively lift a forward part of said platform relative to said lower box to incline said platform in a forward direction or to lift a rearward part of said platform relative to said lower box to decline said platform in a forward direction;

a controller in communication with said four height-adjustable corner supports and with said lifter mechanism, said controller being configured to remotely drive said lifter mechanism to selectively incline or decline said platform and to remotely drive each of said corner supports to selectively raise or lower said lower box at a respective corner thereof.

2. The platform assembly according to claim 1, wherein each of said corner supports comprises a bearing block rigidly mounted to said lower box, an inflatable airbag supported in said bearing block, and a nozzle for fluidically connecting said inflatable airbag to a pressurized air source for inflating said airbag to thereby lift said bearing block and said lower box relative to the floor surface.

3. The platform assembly according to claim 1, wherein each of said corner supports comprises a bearing block rigidly mounted to said lower box and a bracket rigidly connected to said bearing block, said platform having a rigid frame which, in a position of repose of said platform, rests on all four of said bearing blocks and, when said platform is inclined rests on two said bearing blocks of two rear-side corner supports and when said platform is declined rests on two said bearing blocks of two front-side corner supports.

4. The platform assembly according to claim 1, wherein said lifter mechanism comprises:

a linkage formed with first and second links at a forward end of said platform and first and second links at a rearward end of said platform, said linkage being mounted on a rotatable axle with said first and second links enclosing an angle of approximately 90° in a side view thereof, said rotatable axle being rotatably supported on said lower box, and said second link having a free end thereof connected to said platform, wherein a substantially horizontal movement of a free end of said first link translates into a substantially vertical movement of said free end of said second link for lifting said platform at said forward end or at said rearward end;

a motor and a lead screw driven by said motor to selectively rotate in left rotation and in right rotation, said lead screw extending substantially along the longitudinal direction;

a pusher block disposed to mesh with said lead screw and to move along said lead screw when said lead screw is rotated; and a push/pull block disposed at a forward face of said pusher block and a push/pull block disposed at a rearward face of said pusher block, each said push/pull block being connected to move the free end of the respectively associated said first link upon being pushed by said pusher block, to thereby lift either the forward end of said platform or the rearward end of said platform.

5. The platform assembly according to claim 1, wherein said corner supports include inflatable airbags which, upon inflation, lift the respective corner of said lower box a given spacing distance from the floor surface and wherein, with said inflatable airbags inflated, said lower box is raised above the floor surface and supported substantially horizontally and cushioned by said inflated airbags, a pressurized air source for inflating said airbags is fluidically connected to each of said inflatable airbags, and said lifter mechanism is configured to incline or decline said platform independently of an inflation or deflation of said inflatable airbags.

6. The platform assembly according to claim 1, configured for retrofit by removing a spinning cycle from a floor mount and mounting the spinning cycle on said mounting devices on said platform.

7. An exercise studio configuration, comprising:

a display screen and a video system for displaying moving images on said display screen;

a plurality of platform assemblies each according to claim 1 disposed to face said display screen and an exercise bicycle mounted on each of said platform assemblies;

a controller connected to said video system and to each of said platform assemblies, said controller controlling a selective inflation and deflation of said inflatable airbags and a selective raising and lowering of said platform by said lifter mechanism in synchronicity with a content of the moving images being displayed on said display screen.

8. The configuration according to claim 7, wherein said controller is configured to synchronize a plurality of auxiliary devices to the contents of the moving images, the auxiliary devices being selected from the group consisting of one or more blower fans directed towards said platforms, individual pneumatic valves for inflating and deflating said airbags, a rumbler motor disposed in each of said platform assemblies, and a device for setting a resistance of a flywheel of each of the exercise bicycles on said platforms.

* * * * *